United States Patent [19]

Suzuki et al.

[11] 4,308,779

[45] Jan. 5, 1982

[54] CONTROL WAVEFORM GENERATORS FOR ELECTRONIC MUSICAL INSTRUMENTS

[75] Inventors: Hideo Suzuki; Kenji Itakura, both of Hamamatsu; Yasuji Uchiyama, Hamakita, all of Japan

[73] Assignee: Nippon Gakki Seizo Kabushiki Kaisha, Tokyo, Japan

[21] Appl. No.: 125,172

[22] Filed: Feb. 27, 1980

[30] Foreign Application Priority Data

Feb. 28, 1979 [JP] Japan ..... 54-22857

[51] Int. Cl.[3] ..... G10H 1/055; G10H 1/057

[52] U.S. Cl. ..... 84/1.19; 84/1.26; 84/1.27

[58] Field of Search ..... 84/1.11–1.13, 84/1.19–1.27

[56] References Cited

U.S. PATENT DOCUMENTS

| | | | |
|---|---|---|---|
| 3,897,709 | 8/1975 | Hiyoshi et al. | 84/1.19 |
| 3,977,291 | 8/1976 | Southard | 84/1.13 |
| 4,014,238 | 3/1977 | Southard | 84/1.13 |
| 4,109,208 | 8/1978 | Tomisawa et al. | 328/13 |

*Primary Examiner*—S. J. Witkowski

*Attorney, Agent, or Firm*—Thompson, Birch, Gauthier & Samuels

[57] ABSTRACT

In a control waveform generator for an electronic musical instrument of the type wherein the generator generates a control waveform adapted to control at least one of a tone pitch, a tone color and a tone volume, the control waveform generator is constituted by a pulse generator for generating a pulse signal having a repetitive frequency, and a detector including a counter which starts to count the number of the pulse signals when a key is depressed. The detector generates a first detection signal during an interval between depression of the key and a time at which a counter reaches a predetermined value and then produces a second detection signal until the depressed key is released. The control waveform generator further comprises a capacitor whose terminal voltage is taken out as the control waveform, a first charging or discharging circuit responsive to the first detection signal for charging or discharging the capacitor, a second discharging or charging circuit responsive to the second detector signal for discharging or charging the capacitor, and a third discharging or charging circuit for discharging or charging the capacitor when the depressed key is released.

7 Claims, 12 Drawing Figures

CONTROL WAVEFORM GENERATORS FOR ELECTRONIC MUSICAL INSTRUMENTS

BACKGROUND OF THE INVENTION

This invention relates to a control waveform generator for an electronic musical instrument, which utilizes charging and discharging of a capacitor.

A control waveform generator, often called an envelope waveform generator, is used for an electronic musical instrument for varying with time the tonal elements such as pitch, color and volume of a musical tone produced by the musical instrument. A control waveform generated by the control waveform generator is usually applied to a voltage control type variable filter which controls the tone color and to a voltage control type variable gain amplifier which controls the tone volume. The characteristics of the control waveform generator are controlled for varying with time the color and volume of the musical tone produced.

Among the control waveform generators of the type referred to above is one type in which the control waveform is generated by using charging and discharging of a capacitor, and another type wherein a memory device stores a desired control waveform. For example, the former is disclosed in U.S. Pat. No. 3,897,709 to Hiyoshi et. al. dated Aug. 5, 1975 and the latter is disclosed in U.S. Pat. No. 4,109,208 to Tomisawa et. al. dated Aug. 22, 1978.

SUMMARY OF THE INVENTION

Accordingly, it is the principal object of this invention to provide a novel control waveform generator for an electronic musical instrument which can readily be fabricated with integrated circuits and yet can readily vary the control waveform.

According to this invention there is provided a control waveform generator for an electronic musical instrument of the type wherein the generator generates a control waveform adapted to control at least one of a plurality of tone elements, such as a tone pitch, a tone color and a tone volume in response to depression and release of a key among a plurality of keys. The control waveform generator comprises a pulse generator for generating a pulse signal having a repetitive frequency, a detector including a counter which starts to count the number of the pulse signals when a key is released, the detector generating a first detection signal during an interval between depression of the key and a time at which a count of the counter reaches a predetermined value and thereafter generating a second detection signal until the depressed key is released, a capacitor, the terminal voltage of the capacitor being taken out as the control waveform, a first discharging (charging) circuit responsive to the first detection signal for discharging (charging) the capacitor, a second discharging (charging) circuit responsive to the second detection signal for discharging (charging) capacitor and a third discharging (charging) circuit for discharging (charging) the capacitor when the depressed key is released.

The charging and discharging circuits are constituted by parallelly connected tapped resistors and switching transistors connected to the taps for determining the rate of charging and discharging the capacitor.

DESCRIPTION OF THE PREFERRED EMBODIMENT

Figure 1:
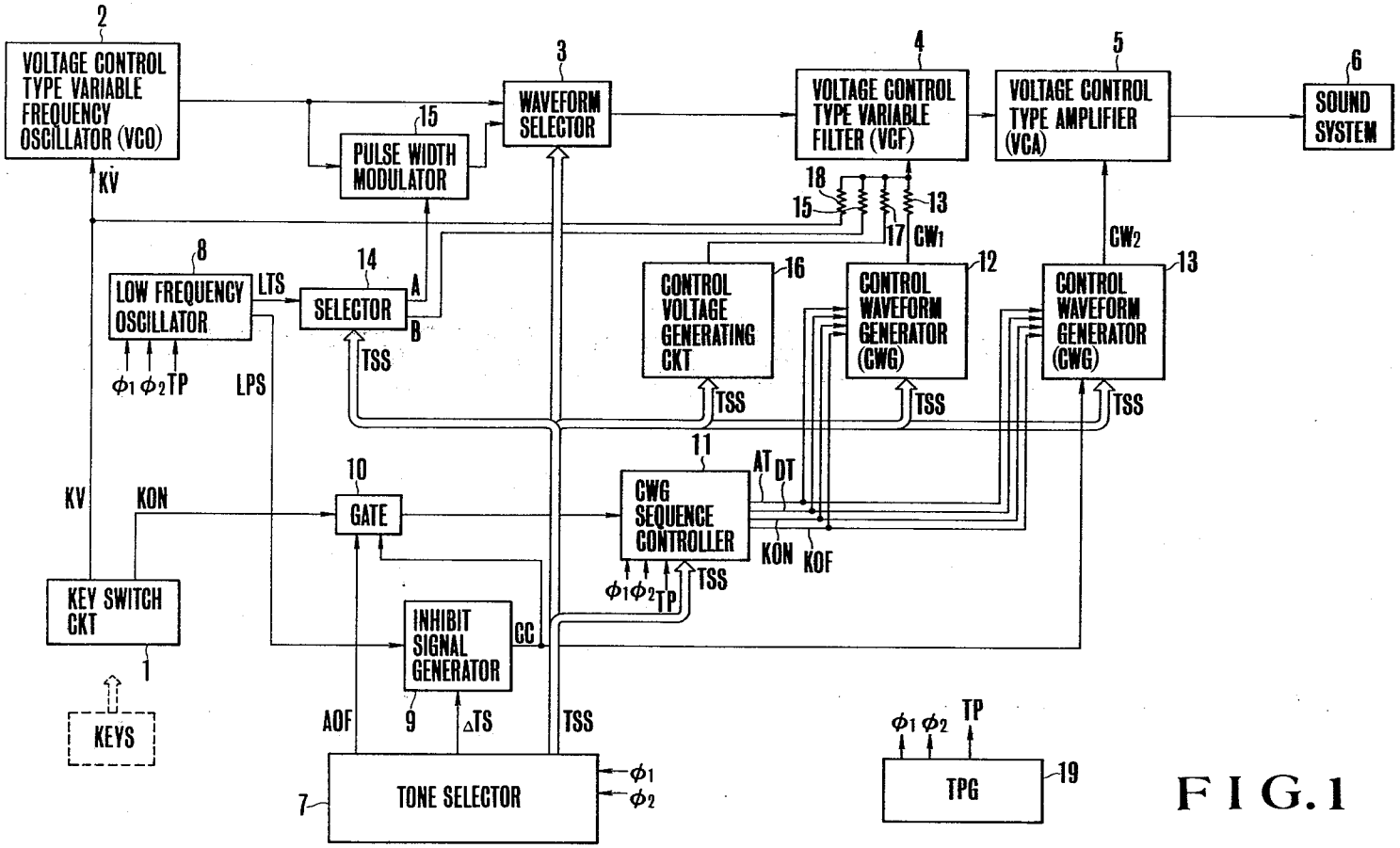
FIG. 1 is a general block connection diagram showing one embodiment of a control waveform generator embodying the invention and utilized in an electronic musical instrument.

A preferred embodiment of the control waveform generator embodying the invention and utilized in an electronic musical instrument will now be described in detail in the following.

In the embodiment of this invention shown in FIG. 1, there is provided a key switch circuit 1 which produces a voltage signal (hereinafter termed a tone pitch voltage KV) having a value corresponding to the tone pitch of a depressed key and a pulse signal (hereinafter termed a key-on signal KON) having a width corresponding to an interval during which the key is held depressed. The tone pitch voltage KV generated by the key switch 1 is applied to a voltage control type variable frequency oscillator 2 (hereinafter termed VCO) as an oscillator drive signal so that the VCO 2 produces a tone source signal corresponding to the tone pitch of the depressed key. The tone source signal produced by the VCO 2 is applied to a voltage control type variable filter 4 (hereinafter termed VCF) through a waveform selector 3, the VCF 4 producing a musical tone signal having a desired tone color. The amplitude envelope of the musical tone signal is then controlled by a voltage control type variable gain amplifier 5 (hereinafter termed VCA) and thereafter supplied to a second system 6 to be produced as a musical tone.

A tone color selector 7 is provided with a plurality of tone color selection switches respectively corresponding to the tone colors of a flute, a trombone, trumpet, etc., and the outputs of these color selection switches are outputted as tone selection signals TSS. Further, the tone color selector 7 is constructed to produce a variation detection signal ΔTS by detecting the change in the states of the color selection switches, and an off state detection signal AOF by detecting the state in which all color selection switches are OFF (nonselection state). A low frequency oscillator 8 (hereinafter called LFO) is constructed to produce a pulse signal LPS having a predetermined period and a triangular waveform signal LTS having a frequency of several hertz to several tens hertz. A inhibit signal generator 9 is constituted by a counter which counts the number of pulse signals supplied from LFO 8 each time a variation detection signal ΔTS is applied so as to continue to produce inhibit signals CC until a predetermined count is reached. A gate circuit 10 is provided to inhibit pass of the key-on signal KON supplied from the key switch 1 only when the off state detection signal AOF is "1" and the tone producing inhibit signal CC is "0" thus preventing production of a musical tone when no tone color selection is made. A control waveform generator sequence controller 11 (hereinafter termed CWG sequence controller) is supplied with the key-on signal KON through the gate circuit 10 to produce the key-on signal KON and a key-off signal KOF obtained by inverting the key-on signal KON. Furthermore, the CWG sequence controller 11 produces an attack signal AT during an interval between the build up of the key-on signal KON and a predetermined time which is designated by the tone color selection signal TSS and a decay signal DT during an interval between above mentioned predetermined time and a time at which the key-on signal KON disappears. The key-on signal KON, the key-off signal KOF, the attack signal AT and the decay signal DT thus formed are supplied to first and second control waveform generators (CWG) 12 and 13. The CWG 12 produces a control waveform $CW_1$ comprising a first decay, a sustain and a second decay in synchronism with the build up of the key-on signal supplied from the CWG sequence controller 11, that is at the same time as a key depression. In this case the CWG 12 controls with time various portions of the generated control waveform $CW_1$ in accordance with the signals AT and DT generated by the CWG sequence controller 11 and also controls the amplitude level of various portions of the control waveform $CW_1$ thus generated in accordance with the tone color selection signal TCS produced by the tone color selection circuit 7. The control waveform $CW_1$ generated by the CWG 12 is applied to the VCF 4 via a resistor 13 so as to delicately vary with time the cutoff frequency and the Q value of the VCF 4 according to the control waveform $CW_1$ thereby producing a musical tone signal whose tone color varies with time. Also the CWG 13 produces a control waveform $CW_2$ in the same manner as the CWG 12, the control waveform $CW_2$ being supplied to the VCA 5 to impart an amplitude envelope to the musical tone signal. At this time, the CWG 13 is supplied with the tone generation inhibit signal CC from the inhibit signal generator 9 so that when a tone generation inhibit signal CC is generated by the inhibit signal generator 9 at the time of changing the selection of tone colors, the CWG 13 rapidly decreases the level of the envelope control waveform $CW_2$, thus preventing production of the musical tone signal.

A selector 14 is provided to select the triangular waveform signal generated by LFO 8 or a suitable voltage in accordance with the tone color selection signal TSS supplied from the tone color selection circuit 7 to produce outputs A and B. The relationship between various tone colors and one example of the contents of outputs A and B of the selector 14 is shown in the following Table 1, wherein the tone color is designated by the tone color selection signal TSS.

TABLE 1

| Tone Color | Output of Selector 14 | |
|---|---|---|
| | Output A | Output B |
| Flute (FL) | DC voltage V1(−1.3V) | DC voltage V3(−2.5V) |
| Trombone (TRB) | V1 | V3 |
| Trumpet (TRP) | V1 | V3 |
| Saxophone (SAX) | V1 | V3 |
| Oboe (OB) | V1 | V3 |
| Violin (VI) | V1 | V3 |
| Harpsichord (HC) | V1 | V3 |
| Jazz guitar (JG) | DC voltage V2(−1.7V) | V3 |
| Electric guitar (ELG) | V2 | V3 |
| Funny (FUN) | V1 | triangular waveform signal LTS |
| Double reed (DR) | triangular waveform signal LTS | V3 |
| Tremulate (TRM) | V1 | V3 |

In this example DC voltage V3 (−2.5 V) corresponds to a reference voltage (center voltage) of the control voltage signal with reference to VCF 4.

A pulse width modulator (PWM) 15 effects pulse width modulation of the tone source signal generated by the VCO 2 by the output A of the selector 14 so as to supply the pulse width modulated output signal to the waveform selector 3. Thus for example, where the tone color selector 7 selects the tone color of the double reed DR, the output A of the selector 14 would become a triangular waveform signal LTS as shown in Table 1 with the result that the PWM circuit 15 produces a tone source signal which is subjected to pulse width modulation in accordance with the triangular waveform signal LTS produced by VCO 2. On the other hand, when the tone color selector 7 selects a tone color of a jazz guitar (JG) or an electric guitar (ELG), the output A of the selector 14 would be a DC voltage V2 (−1.7 V) as shown in Table 1 with the result that the PWC circuit 15 will subject the tone source signal produced by VCO 2 to a definite pulse modulation corresponding to the voltage V2 so as to apply the modulated voltage to the waveform selector 3.

The waveform selector 3 selects either one of the tone signal produced by VCO 2 and the pulse width modulated tone source signals produced by the PWM circuit 15 and supplies the selected tone source signal to the VCF 4. Thus the waveform selector 3 selects either one of 4 types of tone source signals having different waveforms (harmonic components contained therein) according to the tone color selection signal TSS. In this manner, it is possible to produce a tone source signal having a waveform (containing desired harmonic components) suitable for forming a desired tone color.

The output B of the selector 14 is supplied to the VCF 4 via a resistor 15 for controlling the cut off frequency and the Q value of the VCF 4. As shown in Table 1, when the color selection circuit 7 selects the tone color of a funny (FUN) a triangular waveform signal LTS is produced whereas when a tone color other than the funny (FUN) is selected, a DC voltage V3 (−2.5 V) is be produced. Consequently, when the selector 14 produces an output B, i.e. a triangular waveform signal LTS, the cut off frequency (and the Q value) vary periodically to impart a WAH WAH effect upon the inputted tone source signal. On the other hand, when the output B is the DC voltage V3, the cut off frequency would be varied but fixed to a predetermined frequency.

A control voltage generator 16 is provided for the purpose of generating a control voltage signal (a DC voltage) which varies the cut off frequency and the Q value in accordance with the tone color selection signal TSS produced by the tone color selection circuit 7, the control voltage signal being supplied to the VCF 4 via a resistor 17. Consequently, the VCF 4 applies to the input tone source signal a tone color selected by the tone color selection circuit 7. Although in this embodiment, a tone pitch voltage KV corresponding to the tone of a depression key and produced by the key switch 1 is applied to the VCF 4 via a resistor 18, this connection is adapted for the purpose of shifting the cut off frequency of the VCF 4 in accordance with the tone pitch of the depressed key for preventing variation in the tone color of the generated musical tone due to the tone pitch of the depressed key. A timing pulse generator 19 includes a pulse generator for producing main clock pulses having a predetermined period $\phi$, means for forming two phase clock pulses $\phi_1$, $\phi_2$, each having phases opposite each other, by using the main clock pulses $\phi$, and means for forming pulse signals TP having a period the 54 times of main clock pulses $\phi$ and a width equal to the period of the clock pulse $\phi_2$ by using the main clock pulses $\phi$.

Having described the outline of the construction of the electronic musical instrument, the detail of the circuit construction and the operation of various component elements will be described hereunder.

A. Color selector 7

Figure 2:
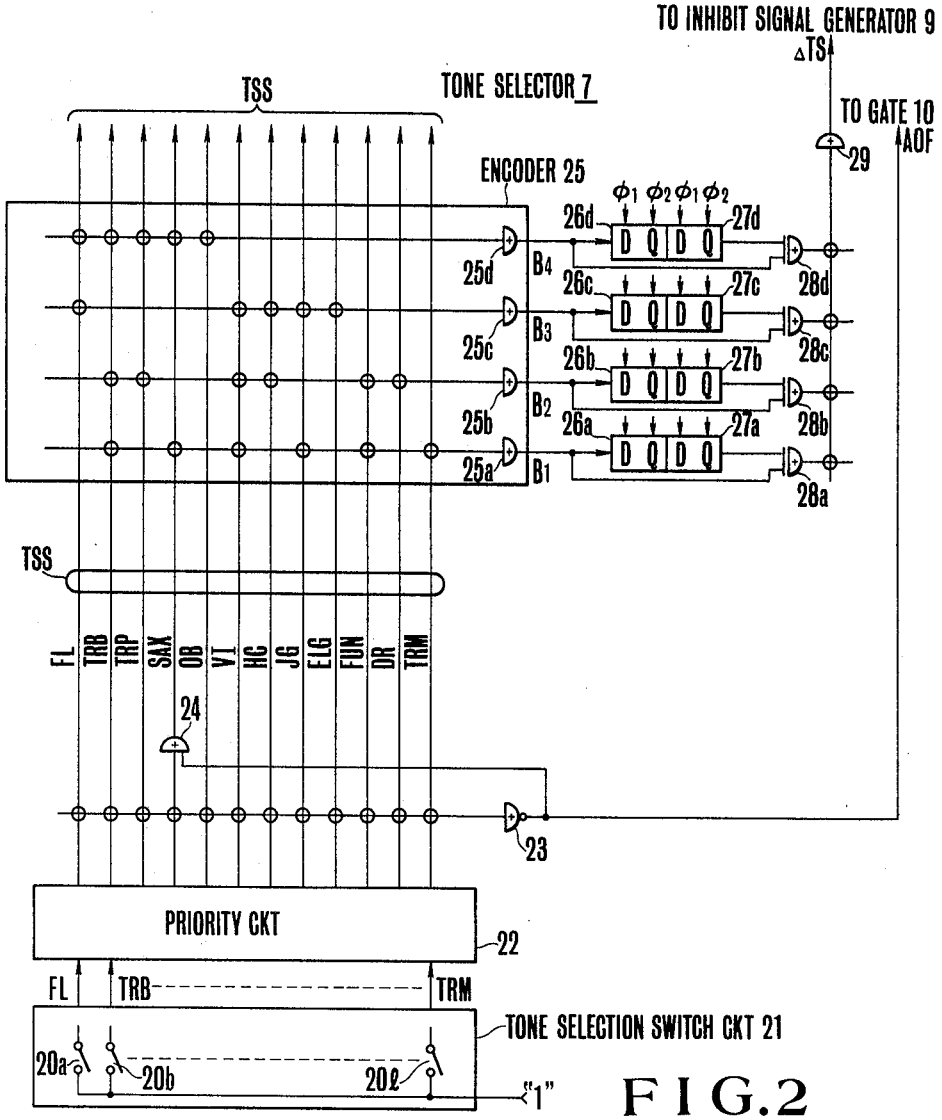
FIG. 2 is a block diagram showing the detail of one example of the tone color selector shown in FIG. 1.

FIG. 2 shows the detail of the tone color selector 7 shown in FIG. 1. The color selector 7 is provided with a plurality of tone color selection switches 20*a*–20*l* which designate the tone colors of the generated musical tone. These color selection switches select tone colors shown in the following Table 2 to produce tone color signals FL-TR.

TABLE 2

| Color Selection Switch | Tone color designation | Tone color signal |
|---|---|---|
| 20a | flute | FL |
| 20b | trombone | TRB |
| 20c | trumpet | TRP |
| 20d | saxophone | SAX |
| 20e | oboe | OB |
| 20f | violin | VI |
| 20g | harpsichord | HC |
| 20h | jazz guitar | JG |
| 20i | electric guitar | ELG |
| 20j | funny | FUN |
| 20k | double reed | DR |
| 20l | tremute | TRM |

Among the tone color signals FL-TRM produced by the color selection switches 20*a*–20*l* of a switch circuit 21, only a signal of the highest priority is selected by the priority circuit 22 and then outputted. A NOR gate circuit 23 is provided on the output side of the priority circuit 22 for detecting the fact that all tone color signals FL-TRM are "0", i.e. all tone selection switches 20*a*–20*l* are in their off state. Accordingly, when all color selection switches 20*a*–20*l* become off, the NOR gate circuit 23 produces an off-state detection signal AOF ("1"). This off state detection signal AOF is supplied to the gate circuit 10 (FIG. 1) and to an OR gate circuit 24 for making the tone color signal SAX to "1". When all tone color selection switches 20*a*–20*l* are turned off so that tone color signals FL, TRB, TRP, SAX, OB, VI, HC, JG, ELG, FUN, DR and TRM are all "0", generation of the voltage signal (output B of selector 14, the output of the control voltage generator 16) which vary the characteristic of the VCF 4 shown in FIG. 1 would cease. Then, when one of the tone color selection switches 20*a*–20*l* is closed to make a corresponding one of color signals FL-TRM to be "1", the voltage signal rapidly changes from zero to a predetermined value so that there is a fear that the characteristics of the VCF 4 change rapidly to form clicks. For the purpose of obviating this problem, the tone color SAX is made to be "1" when all tone color selection switches 20*a*-20 are off.

The tone color selection signal TSS (tone color signals FL-TRM) are converted into 4 bit (B1–B4) code signals for each tone color by OR gate circuits 25*a*–25*d* in an encoder 25, as shown in the following Table 3.

TABLE 3

| Tone Color Signal | Content B4 | B3 | B2 | B1 |
|---|---|---|---|---|
| TRM | 0 | 0 | 0 | 1 |
| DR | 0 | 0 | 1 | 0 |
| FUN | 0 | 0 | 1 | 1 |
| ELG | 0 | 1 | 0 | 0 |
| JG | 0 | 1 | 0 | 1 |
| HC | 0 | 1 | 1 | 0 |
| VI | 0 | 1 | 1 | 1 |
| OB | 1 | 0 | 0 | 0 |
| SAX | 1 | 0 | 0 | 1 |
| TRP | 1 | 0 | 1 | 0 |
| TRB | 1 | 0 | 1 | 1 |
| FL | 1 | 1 | 0 | 0 |

The code signals B1–B4 are applied to delay flip-flop circuits 26*a*–26*d* and 27*a*–27*d* which are connected in series and driven by clock pulses $\phi_1$ and $\phi_2$ to be delayed by 2 bit times (one half period of the clock signal $\phi_1$) and the delayed signals are applied to one inputs of exclusive OR gate circuits 28*a*–28*d*. To the other inputs of these exclusive OR gate circuits are directly applied the code signals B1–B4. Then, the exclusive OR gate circuits 28*a*–28*d* compare code signals B1–B4 produced by encoder 25 with each one of the code signals B1–B4 which are produced 2 bit times before by the encoder 25 so as to detect variations in the code signals B1–B4. In other words, when the selection of the tone color selection switches 20*a*–20*l* of the switch circuit 21 is changed, the content (tone color signals FL-TRM) of the color selection signal TSS varies. As the content of the tone color selection signal varies, at least one bit of the code signals B1–B4 produced by the encoder 25 varies as seen from Table 3. As a consequence, one of the exclusive OR gate circuits 28*a*–28*d* applied with the varied bit signal produces a signal "1" for two slot times. Accordingly, when the selection of the tone color selection switches 20*a*–20*l* is varied, an OR gate circuit 29 supplied with the outputs of respective OR gate circuits 28*a*–28*d* produces a variation detection signal ΔTS ("1") for the two bit times. Thus, encoder 25, delay flip-flop circuits 26*a*–26*d*, 27*a*–27*d* and OR gate circuit 29 constitute a tone color selection variation detector.

B. Low frequency oscillator (LFO) 8

Figures 3, 4:
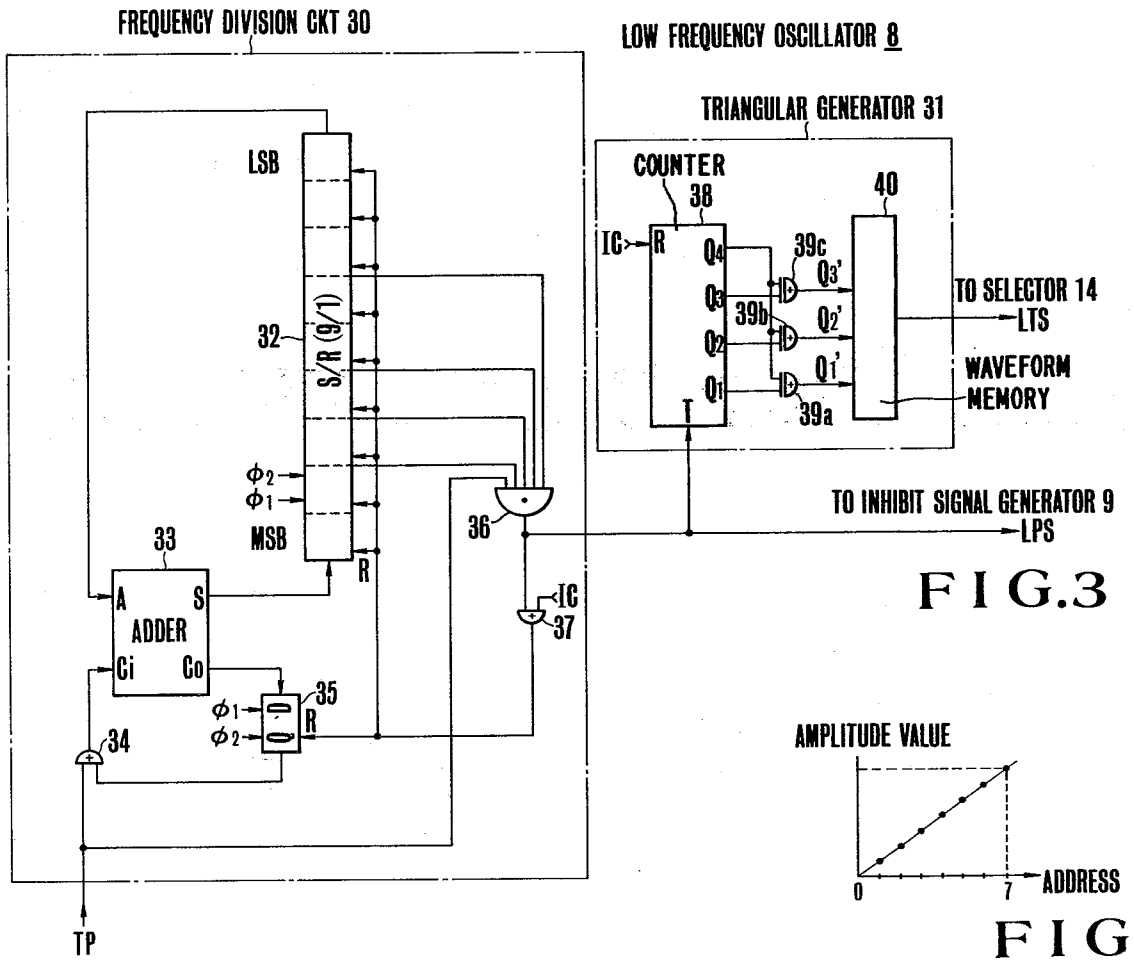
FIG. 3 is a block diagram showing one example of the low frequency oscillator (LFO) shown in FIG. 1.
FIG. 4 is a graph showing one example of a waveform stored in the waveform memory device shown in FIG. 3.

The detail of one example of the LFO 8 shown in FIG. 1 is illustrated in FIG. 3. As shown, it comprises a frequency divider 30 which divides the frequency of the pulse signal TP having a period of 54 times of that of a clock signal $\phi_1$ or $\phi_2$ and a pulse width equal to one period of the clock pulse $\phi_1$ or $\phi_2$ to produce a pulse signal LPS having a divided frequency, and a triangular waveform generator 31 which produce a triangular waveform signal LTS in response to the pulse signal LPS. The frequency divider 30 comprises a 9 stage one bit shift register 32 having a plurality of stages of the number corresponding to a divisor of the period "54 bit times" of the pulse signal and is driven by the clock pulses $\phi_1$ and $\phi_2$, and an adder 33. The adder 33 adds the output signal (9th stage output) of the shift register 32 applied to an addition input A to a pulse signal TP applied to a carry input Ci through an OR gate circuit 34 and supplies the sum to the first state of the shift register 32 from its sum output S. The output signal produced from the carry output Co of the adder 33 is delayed 1 bit time by a delay flip-flop circuits 35 driven by the clock signals $\phi_1$ and $\phi_2$ and then applied to the carry input Ci of the adder 33 through OR gate circuit 34. The outputs from the second, third, fourth and sixth stages of the shift register 32 and the pulse signal TP are applied to the inputs of an AND gate circuit 36 to enable the same for producing a pulse signal LPS which is supplied to respective stages of the shift register 32 and to the delay flip-flop circuit 35 via an OR gate circuit 37 to act as a reset signal.

The frequency divider 30 operates as follows. When an initial clear signal IC is generated as a result of the closure of a source circuit, the OR gate circuit 37 produces a signal "1" to reset the shift register 32 and the delay flip-flop circuit 35. Under these conditions, as the pulse signal TP having a period 54 times of that of the clock pulse $\phi_1$ is applied to the carry input Ci of the adder 33 through the OR gate circuit 34, the adder 33 adds the output (which is now "0" because the shift register 32 is reset by the initial clear signal IC) of the shift register 32 to the pulse signal TP to produce "1" from its sum output S and "0" from its carry output Ci. This "1" signal produced by the sum output S is applied to the first stage of the shift register 32 which is sequentially shifted at each one bit time according to the clock signals $\phi_1$ and $\phi_2$. As above described, the pulse signal applied to the carry input Ci of the adder 33 has a pulse width equal to one period of the clock signal $\phi_2$, i.e. one bit time, the signal "1" outputted from the sum output S of the adder 33 is a pulse signal also having a width of one bit time. Consequently, the shift register 32 sequentially shift the signal "1" produced by the sum output S of the adder 33 and only the 9th stage of the shift register 32 becomes "1" 9 bit times (9 periods of the clock signal $\phi_1$) after appearance of the sum signal "1". The signal "1" at the 9th stage of the shift register 32 is applied to the addition input A of the adder 33 to be added to a signal supplied to the carry input Ci.

As above described, since the pulse signal TP has a period 54 times of that of the clock signal $\phi_2$, there is no pulse signal TP synchronously generated 9 bit times after the generation of the first pulse signal TP. Consequently at this bit time, the sum output S of the adder 33 is "1" while the carry output Co is "0". The signal "1" produced by the sum output S is applied to and then sequentially shifted by the shift register 32 in the same manner as above described. When this operation is repeated 6 times following the generation of the pulse signal TP, that is when 54 bit times elapse after generation of the pulse signal TP, a pulse signal TP is applied to the carry input Ci of the adder 33. At this time, since the signal "1" is applied to the addition input A of adder 33 from the shift register 32, the sum output S of the adder 33 produces "0" whereas the carry output Co produces "1" which is delayed one bit time by the delay flip-flop circuit 35 and then applied to the carry input Ci of the adder 33 via the OR gate circuit 34. At this time, since the output of the shift register 32 applied to the addition input of the adder 33 is "0", the adder 33 produces "1" from its sum output "1" and "0" from its carry output Co. Thus, the "0" and "1" signals from the sum outputs of the adder 33 are sequentially applied to the shift register 32 and then sequentially shifted by the clock pulses $\phi_1$ and $\phi_2$. When this shift operation is repeated 6 times and 54 bit times have elapsed after the second pulse signal TP is generated, the pulse signal TP is again applied to the carry input Ci of the adder to execute an addition operation in the same manner as above described. In this manner, the adder 33 and the shift register 32 comprise a serial type counter which increases its count by one each time the pulse signal TP is generated. Thus, the contents of respective stages of the shift register 32 at the time of generating the pulse signal TP is such that the first stage corresponds to the most significant bit MSB of the count and the 9th stage to the least significant bit LSB. Each time a pulse signal TP is generated, "1" is added to the least significant bit by the adder 33. The contents of respective stages of the shift counter 32 at each generation of the pulse signal TP are shown in the following Table 4.

TABLE 4

| Pulse Signal TP | Contents of the Stages of Shift Register 32 | | | | | | | | |
|---|---|---|---|---|---|---|---|---|---|
| | 1st stage (MSB) | 2nd stage | 3rd stage | 4th stage | 5th stage | 6th stage | 7th stage | 8th stage | 9th stage LSB |
| 1 (first bit time) | 0 | 0 | 0 | 0 | 0 | 0 | 0 | 0 | 0 |
| 2 (54 bit time) | 0 | 0 | 0 | 0 | 0 | 0 | 0 | 0 | 1 |
| 3 (108 bit time) | 0 | 0 | 0 | 0 | 0 | 0 | 0 | 1 | 0 |
| 4 (162 bit time) | 0 | 0 | 0 | 0 | 0 | 0 | 0 | 1 | 1 |
| 5 (216 bit time) | 0 | 0 | 0 | 0 | 0 | 0 | 1 | 0 | 0 |
| . | . | . | . | . | . | . | . | . | . |
| . | . | . | . | . | . | . | . | . | . |

TABLE 4-continued

| Pulse Signal TP | Contents of the Stages of Shift Register 32 | | | | | | | | |
|---|---|---|---|---|---|---|---|---|---|
| | 1st stage (MSB) | 2nd stage | 3rd stage | 4th stage | 5th stage | 6th stage | 7th stage | 8th stage | 9th stage LSB |
| . | . | . | . | . | . | . | . | . | . |
| . | . | . | . | . | . | . | . | . | . |
| 231 (12420 bit times) | 0 | 1 | 1 | 1 | 0 | 0 | 1 | 1 | 1 |
| 232 (12474 bit times) | 0 | 1 | 1 | 1 | 0 | 1 | 0 | 0 | 0 |

As can be noted from this Table, the contents of the first to 9th stages of the shift register 32 at the time of generation of the 232th pulse signal is "011101000". Accordingly, the AND gate circuit 36 inputted with the contents of the second, third, fourth and sixth stages of the shift register 32 and the pulse signal TP is enabled at the time of generation of the 232th pulse signal TP to produce a signal "1" having a pulse width equal to one bit time. As above described this signal "1" is sent out as a pulse signal LPS and is used to reset the delay flip-flop circuit 35 and the shift register 32 via the OR gate circuit 37 to set them again to the initial state. In this manner, the frequency divider 30 functions to divide the pulse signal TP with 232 to produce a pulse signal LPS.

The triangular waveform generator 31 comprises a four bit counter 38 which counts the number of the pulse signals LPS outputted from the AND gate circuit 36, exclusive OR gate circuits 39*a*, 39*b* and 39*c* with their one inputs connected to receive the outputs Q1, Q2 and Q3 respectively of the first, second and third stages of the counter 38 and their other inputs connected to receive the output Q4 (LSB) of the fourth stage of the counter, and a waveform memory device 40 addressed by the outputs Q1', Q2' and Q3' produced by the OR gate circuits 39*a*, 39*b* and 39*c* respectively.

The triangular waveform generator 31 operates as follows. When the frequency divider 30 produces a pulse signal LPS, the counter 38 sequentially counts the number of the pulse signals to produce its counts as 4 bit binary output signals Q1–Q4. Since these output signals are applied to the inputs of the exclusive OR gate circuits 39*a*–39*c* together with the output signal Q4 of the counter 38 to obtain their logical sums, the variation of the outputs of the exclusive OR gate circuits 39*a*–39*c* as the counter 38 counts up is as shown in the following Table 5.

TABLE 5

| Outputs of Counter 38 | | | | Outputs of Exclusive OR Gate 39a–39c | | |
|---|---|---|---|---|---|---|
| Q4 | Q3 | Q2 | Q1 | Q3' | Q2' | Q1' |
| 0 | 0 | 0 | 0 | 0 | 0 | 0 |
| 0 | 0 | 0 | 1 | 0 | 0 | 1 |
| 0 | 0 | 1 | 0 | 0 | 1 | 0 |
| 0 | 0 | 1 | 1 | 0 | 1 | 1 |
| 0 | 1 | 0 | 0 | 1 | 0 | 0 |
| 0 | 1 | 0 | 1 | 1 | 0 | 1 |
| 0 | 1 | 1 | 0 | 1 | 1 | 0 |
| 0 | 1 | 1 | 1 | 1 | 1 | 1 |
| 1 | 0 | 0 | 0 | 1 | 1 | 1 |
| 1 | 0 | 0 | 1 | 1 | 1 | 0 |
| 1 | 0 | 1 | 0 | 1 | 0 | 1 |
| 1 | 0 | 1 | 1 | 1 | 0 | 0 |
| 1 | 1 | 0 | 0 | 0 | 1 | 1 |
| 1 | 1 | 0 | 1 | 0 | 1 | 0 |
| 1 | 1 | 1 | 0 | 0 | 0 | 1 |
| 1 | 1 | 1 | 1 | 0 | 0 | 0 |

Consequently, while the output signals Q1–Q4 of the counter 38 varies from decimal 0 to 15, the three bit output signals Q1'–Q3' of the exclusive OR gate circuits 39*a*–39*c* vary from decimal 0 to 7 and then back to 0 as shown in Table 5. Consequently, when the waveform memory device 40 storing analogue amplitude values as shown in FIG. 4 in respective addresses is addressed by the output signals Q1'–Q3 ' of the exclusive OR gate circuits 39*a*–39*c*, the waveform generator 40 would produce a triangular waveform signal LTS having a period equal to the full count period of the counter 38.

C. Inhibit signal generator 9 and gate circuit 10

Figure 5:
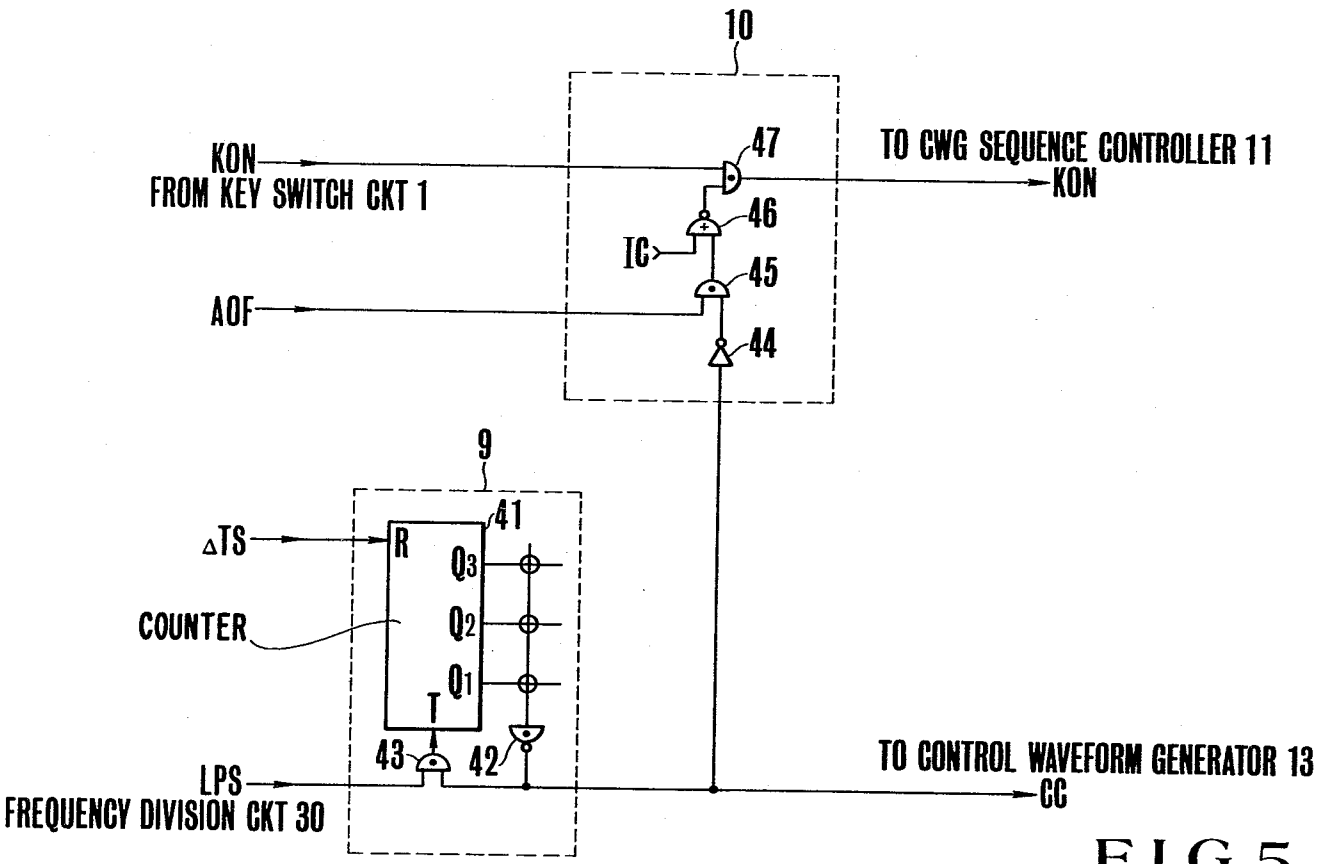
FIG. 5 is a connection diagram showing the detail of one example of the inhibit signal generator and the gate circuit shown in FIG. 1.

FIG. 5 shows the detail of one example of these circuits. The inhibit signal generator 9 comprises a 3 bit counter 41 which is reset by the variation detection signal TS generated for a definite time during the selection of the tone color selection switches 20*a*–20*l* (FIG. 2) and supplied through the OR gate circuit 29 shown in FIG. 2, a NAND gate circuit 42 supplied with the outputs Q1–Q3 at respective stages of the counter 41, and an AND gate circuit 42 supplied with the signal "1" produced by the NAND gate circuit 42 and a pulse signal LPS produced by the frequency divider 30 shown in FIG. 3 to produce an output signal "1" which is supplied to the counter 41 as a count signal.

Accordingly, as the state variation detection signal ΔTS is produced by the OR gate circuit 29 shown in FIG. 2, the counter 41 is reset. Then its output signals Q1–Q3 become "0" with the result that the output signal of the NAND gate circuit 42 becomes "1". As a consequence, the AND gate circuit 43 is enabled, so that the pulse signal produced by the frequency divider 30 shown in FIG. 3 would be applied to the counter 41 via the AND gate circuit 43 whereby the counter 41 sequentially counts up at each generation of the pulse signal LPS. After being reset by the state variation detection signal ΔTS as the counter 41 counts 7 pulse signals, its outputs Q1–Q3 become all "1", and hence the output of the NAND gate circuit 42 becomes "0". Then, the AND gate circuit 43 is disabled to prevent the pulse signal LPS from being inputted to the counter 41, whereby the counter 41 continues to maintain its full count state (outputs Q1–Q3 are all "1") until it will be reset by the next state variation detection signal ΔTS. Accordingly, the NAND gate circuit 42 produces a signal "1" over an interval between the generation of the state variation detection signal ΔTS and a time at which the counter 41 has counted 7 pulse signals LPS. This output signal "1" of the NAND gate circuit 42 is used as a tone generation inhibit signal CC at the time of changing the tone color selection.

The gate circuit 10 comprises an inverter 44 that inverts the tone generation inhibit signal CC, an AND gate circuit 45 inputted with the off state detection signal AOF produced by the NOR gate circuit 23 shown in FIG. 2 and the output of inverter 44, a NOR gate circuit 46 inputted with the output signal of the AND gate circuit 45 and the initial clear signal IC, and an AND gate circuit 47 inputted with the output of the NOR gate circuit 46 and the key-on signal KON supplied from the key switch 1.

The gate circuit 10 operates as follows. More particularly, during an interval in which the initial clear signal IC is being generated, the output of the NOR gate circuit 46 becomes "0" to disable the AND gate circuit 47, thus preventing generation of the key-on signal KON to inhibit tone generation. Then, as the selection of the tone color selection signal shown in FIG. 2 is changed, the inhibit signal generator 9 produces a tone generation inhibit signal CC for a definite interval as above described. This tone generation inhibit signal CC is inverted by the inverter 44 and then applied to the AND gate circuit 45 so that the output of the AND gate circuit 45 becomes "0" and hence the output of the NOR gate circuit 46 becomes "1". Consequently, the AND gate circuit 47 is enabled to continuously supply the key-on signal KON produced by the key switch 1 shown in FIG. 1 to the CWG sequence controller 11. This is made for the purpose of preventing the following disadvantage. More particularly, if the tone color is switched while a key is being depressed, the key-on signal KON is temporarily interrupted (to become "0") by a momentarily generated state detection signal AOF, so that the CWG sequence controller 11 misjudges that as if the depressed key were released and then depressed again to control again the CWG's 12 and 13 to attack states.

When an off state detection signal AOF is generated after disappearance of the tone generation inhibit signal CC, the output of the AND gate circuit 45 which is inputted with the output signal "1" of the inverter 44 which inverts the tone generation inhibit signal CC ("0") and the off state detection signal AOF ("1") becomes "1". Then, the output of the NOR gate circuit 46 becomes "0" to disable the AND gate circuit 47 thereby preventing the key-on signal KON from passing through the AND gate circuit 47 to inhibit tone generation. Thus, when all tone color selection switches 20*a*–20*l* (FIG. 2) are off, no musical tone would be produced.

D. CWG sequence controller 11

Figure 6:
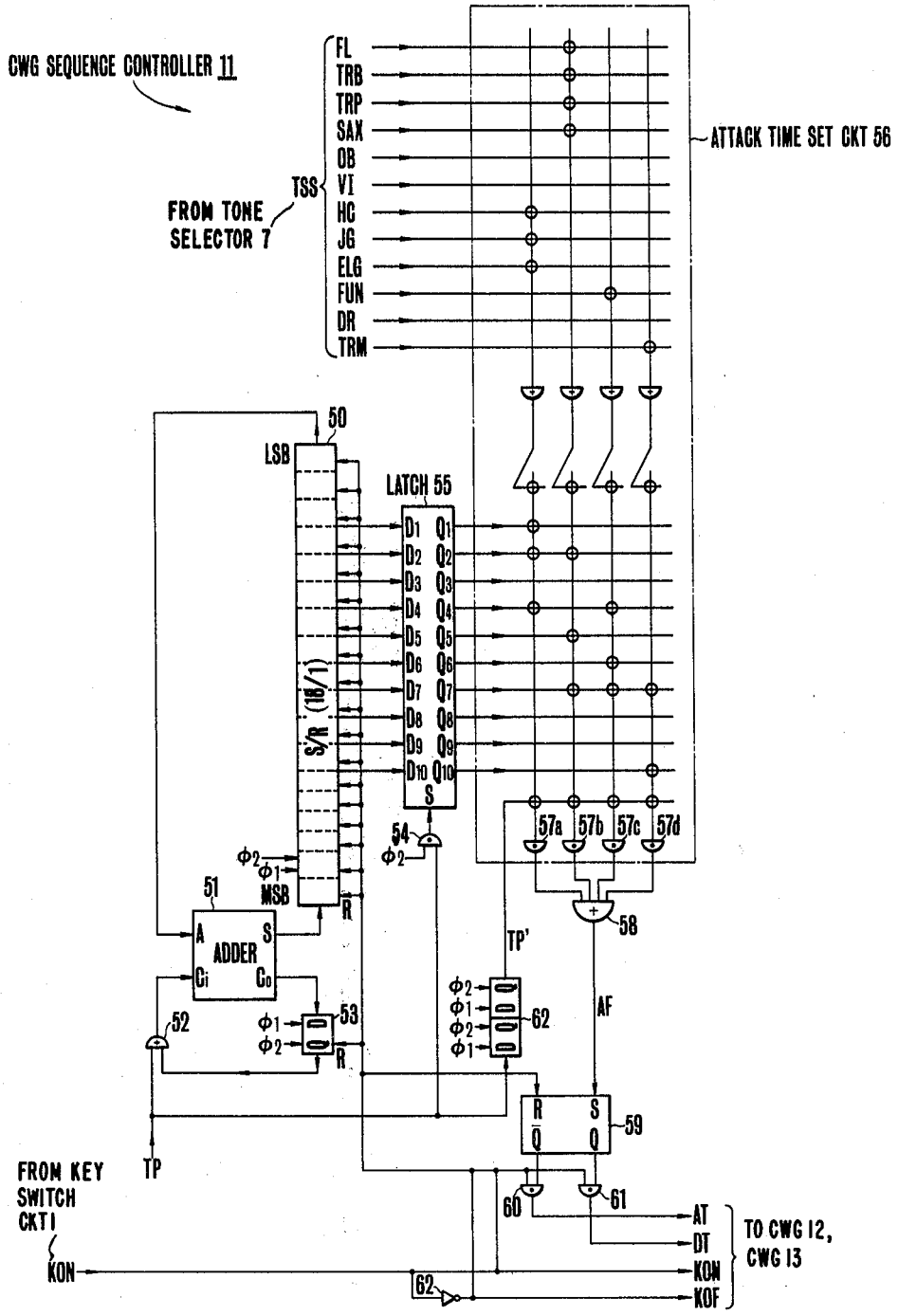
FIG. 6 is a connection diagram showing the detail of one example of the CWG sequence controller shown in FIG. 1.

FIG. 6 shows the detail of one example of the CWG sequence controller 11 shown in FIG. 1. As shown, it comprises an 18 stage one bit shift register 50 having a plurality of stages of a number corresponding to the divisor of the period (54 bit times) of the pulse signal TP, and driven by clock pulses $\phi_1$ and $\phi_2$, and an adder 51. This adder 51 adds the output signal (the output of the 18th stage) of the shift register 50 applied to a sum input A to the pulse signal TP applied to its carry input Ci via an OR gate circuit 52, and produces its sum through its sum output S and carry output Co. The sum output S is applied to the first stage of the shift register 50, while the carry output Co is delayed one bit time by a delay flip-flop circuit 53 driven by the clock signals $\phi_1$ and $\phi_2$ for delaying the carry output by one bit time, and then applied to a carry input Ci of the adder 51 via OR gate circuit 52. The adder 51 and the shift register 50 operate in the same manner as the adder 33 and the shift register 32 of the frequency divider 30 (FIG. 3) thus constituting a serial type counter which increases its count by one at each generation of the pulse signal TP. The contents at respective stages of the shift register 50 at the time of generation of the pulse signal TP are such that the count of the first stage corresponds to the most significant bit MSB, whereas the 18th stage corresponds to the least significant bit LSB. The outputs from the 6th to 15 stages of the shift register 50 are applied to input terminals D1–D10 respectively of a latch circuit 55. To the stroke signal input terminal S of the latch circuit 55 is applied the output signal of an AND gate circuit 54 supplied with the pulse signal TP and the clock signal $\phi_2$ and the latch circuit 55 latches the output signals of the 6th to 15th stages of the shift register 50 which are supplied to its input terminals D1–D10 when the pulse signal TP is generated. Accordingly, the ouputs Q1–Q10 of the latch circuit 55 respectively represent the bit contents corresponding to $2^3$, $2^4$, $2^5$, $2^6$, $2^7$, $2^8$, $2^9$, $2^{10}$, $2^{11}$ and $2^{12}$ of the counts obtained by counting the number of pulse signals TP by a counter constituted by the adder 51 and the shift register 50. The latch outputs Q1–Q10 of the latch circuit 55 are supplied to an attack time setting circuit 56.

The attack time setting circuit 56 is supplied with the latch outputs and a signal TP′ which is obtained by delaying two bit times the tone color selection signal TSS (tone color signals FL-TRM) as the pulse signal TP with a delay flip-flop circuit 62. The attack time setting circuit 56 comprises four AND gate circuits 57*a*–57*d* each supplied with latch outputs Q1–Q10, tone color signals FL-TRM and signal TP′ as diagrammatically shown in FIG. 6. The conditions of respective AND gate circuits 57*a*–57*d* are shown by the following logic equations (1) to (4), respectively.

AND gate circuit 57*a*:

$$TP' \cdot Q4 \cdot Q2 \cdot Q1 \cdot (HC + JG + ELG) \quad (1)$$

AND gate circuit 57*b*:

$$TP' \cdot Q7 \cdot Q5 \cdot Q2 \cdot (FL + TRB + TRP + SAX) \quad (2)$$

AND gate circuit 57*c*: $TP' \cdot Q7 \cdot Q6 \cdot Q4 \cdot FUN$ (3)

AND gate circuit 57*d*: $TP' \cdot Q10 \cdot Q7 \cdot TRM$ (4)

Thus, in the attack circuit setting circuit 56, predetermined values as shown in the following Table 6 (corresponding to attack times) have been set for respective tone colors (flute, trombone . . . tremulate) so that when the values of the latch outputs Q1–Q10 of the latch circuit 55 match with predetermined values designated by the selected tone color signals (FL-TRM), either one of the AND gate circuits 57*a*–57*d* would produce an output "1" in synchronism with the signal TP′.

TABLE 6

| Tone Color | Set Value (decimal) | Outputs of Latch Circuit 55 | | | | | | | | | | Outputs of AND Gates 57 | | | |
|---|---|---|---|---|---|---|---|---|---|---|---|---|---|---|---|
| | | Q10 (MSB) | Q9 | Q8 | Q7 | Q6 | Q5 | Q4 | Q3 | Q2 | Q1 (LSB) | 57a | 57b | 57c | 57d |
| HC | | | | | | | | | | | | | | | |
| JG | 88 | 0 | 0 | 0 | 0 | 0 | 0 | 1 | 0 | 1 | 1 | 1 | 0 | 0 | 0 |
| ELG | | | | | | | | | | | | | | | |
| FL | | | | | | | | | | | | | | | |
| TRB | | | | | | | | | | | | | | | |

TABLE 6-continued

| Tone Color | Set Value (decimal) | Outputs of Latch Circuit 55 Q10 (MSB) | Q9 | Q8 | Q7 | Q6 | Q5 | Q4 | Q3 | Q2 | Q1 (LSB) | Outputs of AND Gates 57 57a | 57b | 57c | 57d |
|---|---|---|---|---|---|---|---|---|---|---|---|---|---|---|---|
| TRP | 656 | 0 | 0 | 0 | 1 | 0 | 1 | 0 | 0 | 1 | 0 | 0 | 1 | 0 | 0 |
| SAX | | | | | | | | | | | | | | | |
| FUN | 832 | 0 | 0 | 0 | 1 | 1 | 0 | 1 | 0 | 0 | 0 | 0 | 0 | 1 | 0 |
| TRM | 4608 | 1 | 0 | 0 | 1 | 0 | 0 | 0 | 0 | 0 | 0 | 0 | 0 | 0 | 1 |

The output signals of the AND gate circuits 57*a*–57*d* of the attack time setting circuit 56 is applied to the set input 5 of a flip-flop circuit 59 via the OR gate circuit 58 as an attack termination signal AF. The reset output Q of the flip-flop circuit 59 is outputted as an attack signal AT via an AND gate circuit 60 enabled by a key-on signal KON ("1"), whereas the set output Q is outputted as a decay signal DT via an AND gate circuit 61 enabled by the key-on signal KON ("1"). The reason that the pulse signal TD is delayed by two bit times with the delay flip-flop circuit 62 and then applied to the AND gate circuits 57*a*–57*d* is to enable the latch outputs Q1–Q10 of the latch circuit 55 to stably operate the AND gate circuits 57*a*–57*d*.

With the CWG sequence controller 11 described above, when a key-on signal KON ("1") is supplied from the key switch 1 shown in FIG. 1, the AND gate circuit 60 is enabled to produce an attack signal AT ("1").

Under these states, when a pulse signal TP having a period of 54 bit times is applied to the carry input Ci of adder 51 via the OR gate circuit 52, the counter constituted by the adder 51 and the shift register 50 operates in the same manner as the above described frequency dividing circuit 30 (FIG. 3) to sequentially increase its count at each generation of the pulse signal TP. The latch circuit 55 latches the bit contents corresponding to the counts $2^3$–$2^{12}$ of the counter, i.e. the output signals of the 6th to 15th stages of the shift register 50 in synchronism with the clock pulse $\phi_2$ each time the clock pulse TP is generated. The content and the latch outputs Q1–Q10 of the latch circuit 55 vary with the generation of the pulse signal TP. One example of the contents of respective stages of the shift register and the latch outputs Q1–Q16 of the latch circuit at the time of generation of the pulse signal TP are shown in the following Tables 7I and 7II.

TABLE 7I

| Generation of Pulse TP | Content of Respective Stages of Shift Register 50 1st (MSB) | 2nd | 3rd | 4th | 5th | 6th | 7th | 8th | 9th | 10th | 11th | 12th | 13th | 14th | 15th | 16th | 17th | 18th (LSB) |
|---|---|---|---|---|---|---|---|---|---|---|---|---|---|---|---|---|---|---|
| 1 | 0 | 0 | 0 | 0 | 0 | 0 | | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 | 0 | 0 | 0 | 0 | 0 | 1 |
| 3 | 0 | 0 | 0 | 0 | 0 | 0 | 0 | 0 | 0 | 0 | 0 | 0 | 0 | 0 | 0 | 0 | 1 | 0 |
| . | | | | | | | | | | | | | | | | | | |
| . | | | | | | | | | | | | | | | | | | |
| . | | | | | | | | | | | | | | | | | | |
| 9 | 0 | 0 | 0 | 0 | 0 | 0 | 0 | 0 | 0 | 0 | 0 | 0 | 0 | 0 | 1 | 0 | 0 | 0 |
| 10 | 0 | 0 | 0 | 0 | 0 | 0 | 0 | 0 | 0 | 0 | 0 | 0 | 0 | 0 | 1 | 0 | 0 | 1 |
| . | | | | | | | | | | | | | | | | | | |
| . | | | | | | | | | | | | | | | | | | |
| . | | | | | | | | | | | | | | | | | | |
| 17 | 0 | 0 | 0 | 0 | 0 | 0 | 0 | 0 | 0 | 0 | 0 | 0 | 0 | 1 | 0 | 0 | 0 | 0 |
| 18 | 0 | 0 | 0 | 0 | 0 | 0 | 0 | 0 | 0 | 0 | 0 | 0 | 0 | 1 | 0 | 0 | 0 | 0 |
| . | | | | | | | | | | | | | | | | | | |
| . | | | | | | | | | | | | | | | | | | |
| . | | | | | | | | | | | | | | | | | | |
| 25 | 0 | 0 | 0 | 0 | 0 | 0 | 0 | 0 | 0 | 0 | 0 | 0 | 0 | 1 | 1 | 0 | 0 | 0 |
| . | | | | | | | | | | | | | | | | | | |
| . | | | | | | | | | | | | | | | | | | |
| . | | | | | | | | | | | | | | | | | | |

TABLE 7II

| Generation of Pulst TP | Latch Outputs of Latch Circuit 55 Q10 | Q9 | Q8 | Q7 | Q6 | Q5 | Q4 | Q3 | Q2 | Q1 |
|---|---|---|---|---|---|---|---|---|---|---|
| 1 | 0 | 0 | 0 | 0 | 0 | 0 | 0 | 0 | 0 | 0 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| . | | | | | | | | | | |
| . | | | | | | | | | | |
| . | | | | | | | | | | |
| 9 | 0 | 0 | 0 | 0 | 0 | 0 | 0 | 0 | 0 | 1 |
| 10 | 0 | 0 | 0 | 0 | 0 | 0 | 0 | 0 | 0 | 1 |
| . | | | | | | | | | | |
| . | | | | | | | | | | |
| . | | | | | | | | | | |
| 17 | 0 | 0 | 0 | 0 | 0 | 0 | 0 | 0 | 1 | 0 |
| 18 | 0 | 0 | 0 | 0 | 0 | 0 | 0 | 0 | 1 | 0 |
| . | | | | | | | | | | |
| . | | | | | | | | | | |
| . | | | | | | | | | | |
| 25 | 0 | 0 | 0 | 0 | 0 | 0 | 0 | 0 | 1 | 1 |
| . | | | | | | | | | | |
| . | | | | | | | | | | |
| . | | | | | | | | | | |

As the values of the latch outputs Q1–Q10 of the latch circuit 55 reach preset values (See Table 6) designated by the selected tone color signals (FL-TRM), an AND gate circuit (one of 57*a*–57*d*) supplied with the tone color signal (one of FL-TRM) of the attack time set circuit 56 produces a signal "1" which is supplied to the set terminal S of the flip-flop circuit 59 via OR gate circuit 58 to act as the attack termination signal to set the flip-flop circuit 59 whereby its set output Q becomes "1" and the reset output Q becomes "0". Consequently, the AND gate circuit 61 produces a decay signal DT ("1"), while the attack signal AT produced by the AND gate circuit 60 becomes "0".

Then, when the key-on signal KON becomes "0" as a result of the release of a depressed key at the key switch 1, the output of the inverter 62 becomes "1" to generate a key-off signal KOF. As the output signal of the inverter 62 becomes "1", the shift register 50, and the delay flip-flop circuit 53 and the flip-flop circuit 59 are reset to stop the counting operation of the number of the pulse signals effected by the adder 51 and the shift register 50. Also generation of the decay signal DT is also stopped (signal DT becomes "0").

E. Control waveform generator (CWG) 12

Figure 7:
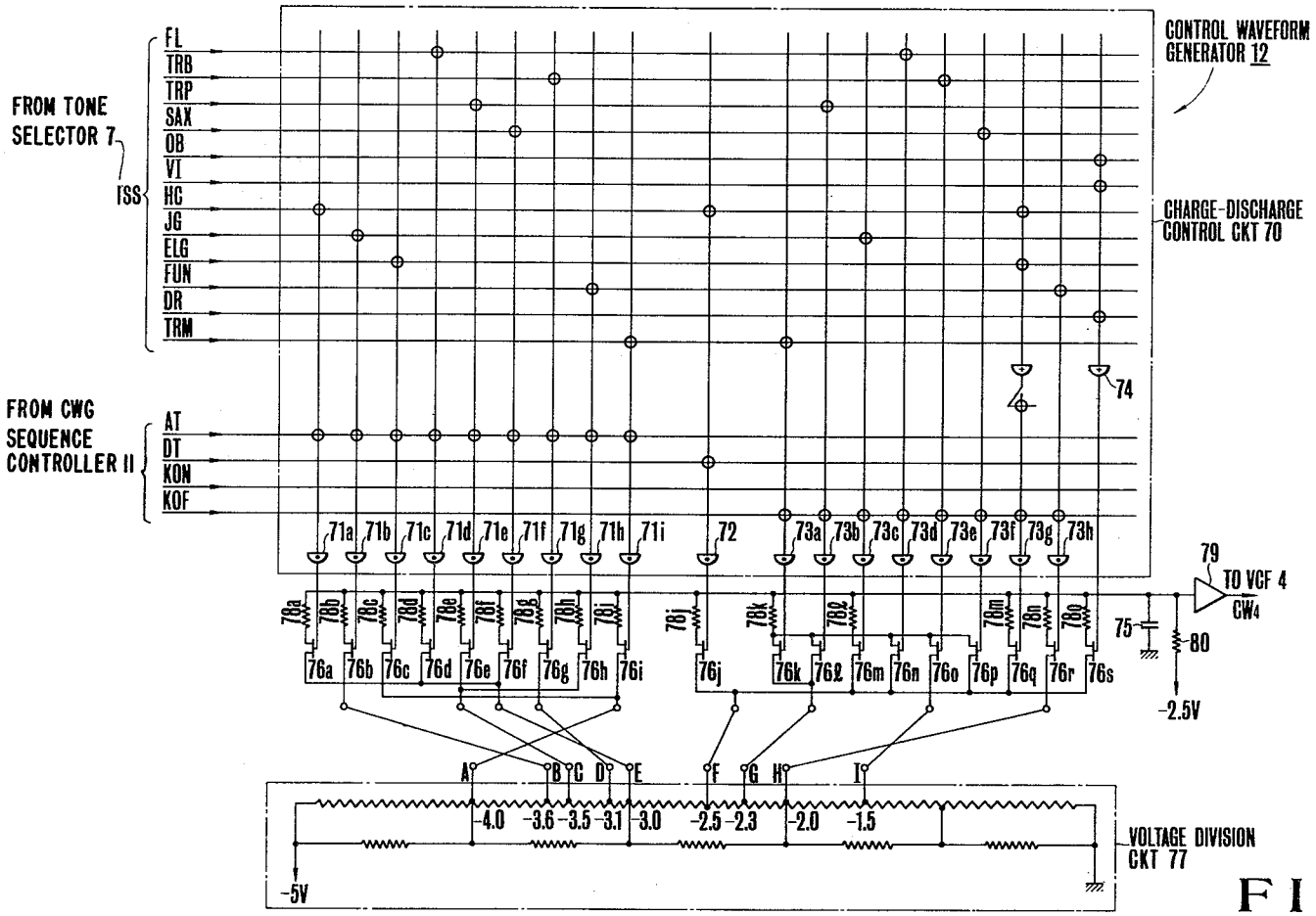
FIG. 7 is connection diagram showing the detail of one example of a control waveform generator CWG for the voltage control type variable filter VCF shown in FIG. 1.

As shown in detail in FIG. 7, the CWG 12 comprises a charging and discharging control circuit 70 controlled by the tone color selection signal TSS (tone color signals FL-TRM) produced by the tone color selection circuit shown in FIG. 2, the attack signal AT produced by the CWG sequence control circuit 11 shown in FIG. 6, the decay signal DT, the key-on signal KON and the key-off signal KOF. The charging and discharging control circuit 70 comprises AND gate circuits *71a–71i* which control the attack portion of the envelope control waveform CW1 generated, an AND gate circuit 72 that controls the first decay portion, and AND gate circuits *73a–73h* that control the second decay portion and an OR gate circuit 74. The output conditions of the AND gate circuits 71, 72 and 73 and the OR gate circuit 74 are shown in the following Table 8.

TABLE 8

| gate | Output condition |
|---|---|
| 71a | HC . AT |
| 71b | JG . AT |
| 71c | ELG . AT |
| 71d | EL . AT |
| 71e | TRD . AT |
| 71f | SAX . AT |
| 71g | TRB . AT |
| 71h | FUN . AT |
| 71i | TRM . AT |
| 72 | HC . DT |
| 73a | TRM . KOE |
| 73b | TRP . KOF |
| 73c | JG . KOF |
| 73d | FL . KOF |
| 73e | TRB . KOF |
| 73f | SAX . KOF |
| 73g | (HC + EG) . KOF |
| 73h | FUN . KOF |
| 74 | OB + VI + DR |

The control waveform generator 12 shown in FIG. 7 comprises a capacitor 75, a voltage division circuit or potentiometer 77, and transistors *76a–76s* which select the voltages at respective junctions or taps A-I of the potentiometer 77 in accordance with the outputs of AND gate circuits *71a–71i*, 72, *73a–73h* and OR gate circuit 74 of the charging voltage control circuit 70 and then apply the selected voltage to the capacitor 75 via resistors *78a–78o*, and a buffer amplifier 79 which supplies the terminal voltage of the capacitor 75 to the VCF 4 shown in FIG. 1 to act as a control waveform $CW_1$. A plurality of stages (in this embodiment, two) of the tapped resistors are connected in parallel across a DC source and the circuit ground to form the potentiometer 77 in the form of a resistance ladder circuit. The potentiometer 77 is constructed to have a low output impedance thus stably producing a large output current. The voltages (corresponding to fractions of a voltage between −5 V and the ground voltage) have a relationship A<B<C<D<E<F<G<H<I. The resistance values of resistors *78a–78d* are made different such that the resistor *78a* would have a minimum value. A reference voltage of −2.5 V is impressed upon the input of the buffer amplifier 79 via a resistor 80 having a relatively high resistance value.

With the control waveform generator CWG 12 described above, suppose now that the tone color selection circuit 7 shown in FIG. 2 selects the tone color of a trombone (switch *20b* is closed). Then, only the tone color selection signal TRB among tone color selection signals TSS becomes "1". At the initial state, since a key-off signal KOF ("1") is produced by the CWG sequence control circuit 11 shown in FIG. 6 and AND gate circuit *73e* of the charging and discharging control circuit 70 produces an output signal "1" as shown in Table 8. This output signal "1" turns ON the transistor *76o* to apply the voltage as the junction I of the potentiometer 77 to the capacitor 75 via resistor *78k*. When the voltage of the junction I is made to be −1.5 V, for example, the terminal voltage of the capacitor 75 at the initial state would be −1.5 V which is outputted from the buffer amplifier 79 as an initial level IL.

Figure 11:
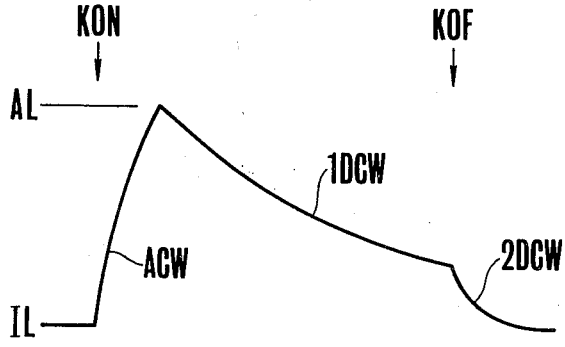

Then, when a key-on signal KON ("1") is produced by the key switch 1 shown in FIG. 1 as a result of the depression of a key, the CWG sequence controller 11 shown in FIG. 11 produces an attack signal AT ("1") at a different time (dfferent depending upon the tone color selected by the tone color selection circuit 7). Consequently, as shown in Table 8, the AND gate circuit *71g* of the charging and discharging control circuit 70 produces an "1" signal at the time of generation of the attack signal AT. As a consequence, the transistor *76g* is turned on to select and apply the voltage (−3.1 V) of the junction D of the potentiometer 77 to the capacitor 75 via resistor *78g* as an attack level AL. Thus, the capacitor 75 is charged to the voltage (−3.1 V) at the junction D as shown by ACW in FIG. 8 with a time constant determined by the value of the resistor *78g* and the capacitance of the capacitor 75 thereby forming an attack waveform.

Figure 8:
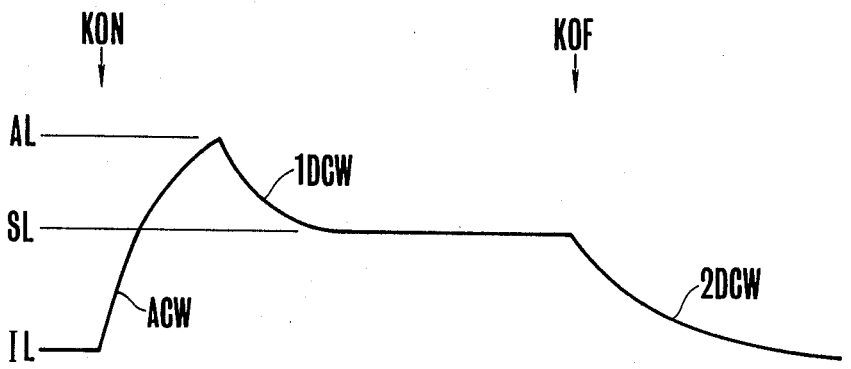
FIG. 8 is a waveform for explaining the operation of the CWG shown in FIG. 7.

After elapse of the aforementioned predetermined time, the attack signal AT generated by the CWG sequence control circuit 11 (FIG. 6) becomes "0" and this signal is substituted by a decay signal DT("1"). As the attack signal AT becomes "0" the transistor *76g* is turned off so that application of the voltage (−3.1 V) at the junction D of the potentiometer 77 would cease. On the other hand, the decay signal DT("1") is applied to the AND gate circuit 72 of the charging and discharging control circuit 70. At this time, since the tone color signal HC is "0" the AND gate circuit 72 is disabled. In other words, under these states AND gate circuits *71a–71i*, 72, *73a–73h* and OR gate circuit 74 are all disabled to turn off all of the transistors *76a–76s*. Accordingly, the charge of the capacitor 75 discharges toward −2.5 V through resistor 80 thus forming a first decay waveform 1 DCW shown in FIG. 8 Thus, the voltage of −2.5 V applied to the capacitor 75 via resistor 80 sets the sustain level SL. When a key off signal KOF("1") is generated by the CWG sequence control circuit 11 as a result of key release, the output signal of the AND gate circuit *73e* of the charging and discharging control circuit 70 becomes "1" as shown in Table 8. Then, the transistor *76o* is turned on to apply the voltage (−1.5 V) at the junction I of the potentiometer 77 across the capacitor 75. As a consequence, the charge of the capacitor 75 of the sustain level (−2.5 V) is discharges toward the voltage at the junction I via resistor 78*k*, i.e. toward the initial level IL(−1.5 V) to form the second decay waveform 2DCW shown in FIG. 8. By outputting the capacitor terminal voltage which varies as above described via the buffer amplifier 79, it is possible to obtain an envelope control waveform CW1 as shown in FIG. 8 for controlling the VCF4 to obtain the tone color of a trombone.

F. Control waveform (CWG) generator 13

Figure 9:
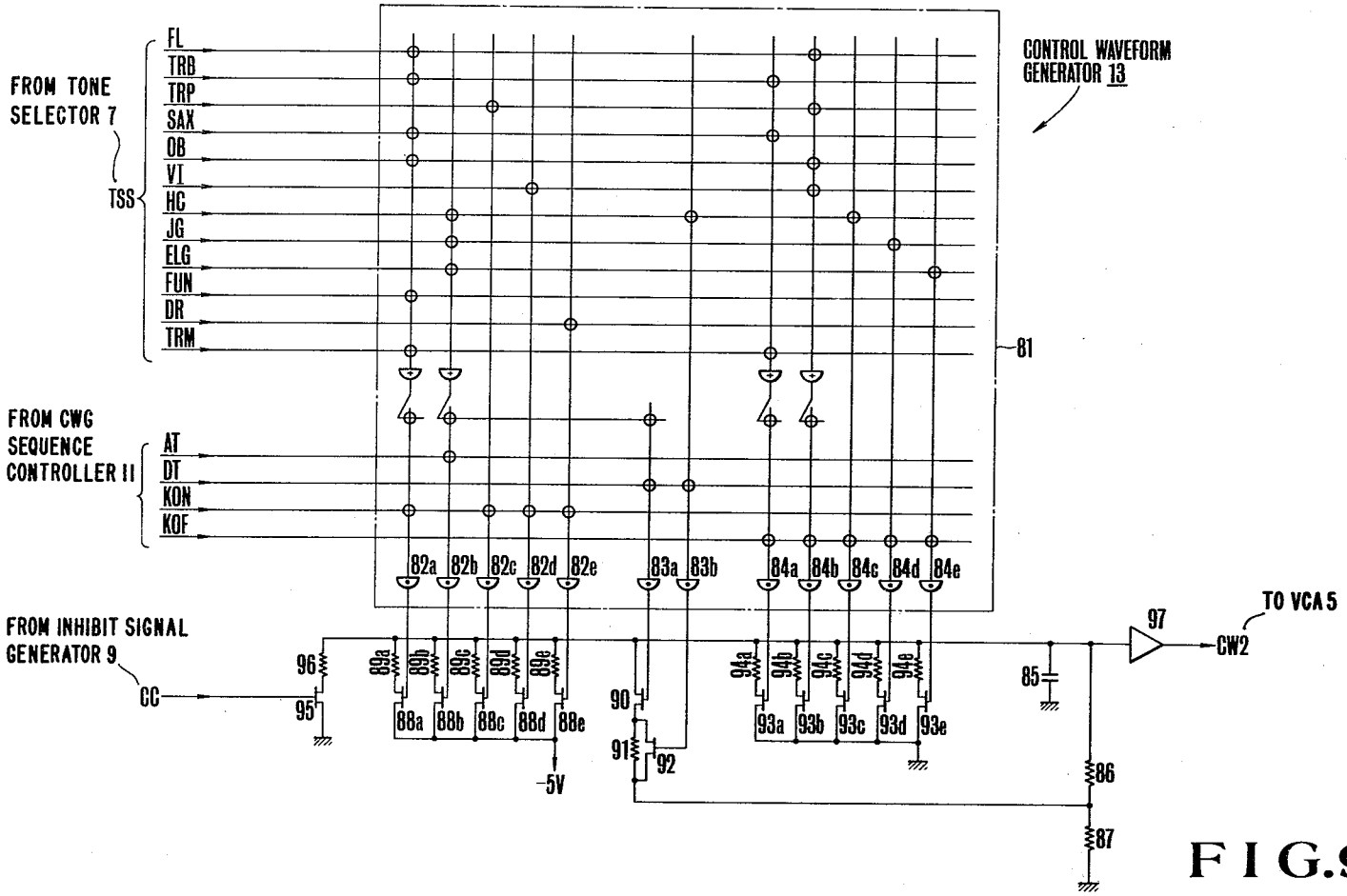
FIG. 9 is a connection diagram showing the detail of one example of the voltage control type amplifier VCA shown in FIG. 1.

FIG. 9 is a connection diagram showing the detail of one example of the CWG 13 shown in FIG. 1. This CWG 13 includes a charging and discharging control circuit 81 controlled by the tone color selection signal TSS (tone color signals TL-TRM) produced by the tone color selection circuit 7 shown in FIG. 2, and the attack signal AT, the decay signal DT, the key-on signal KON and the key-off signal KOF which are produced by the CWG sequence control circuit 11 shown in FIG. 6. The charging and discharging control circuit 81 comprises AND gate circuits 82*a*–82*e* which control the attack portion of the envelope control waveform CW1 generated, AND gate circuits 83*a* and 83*b* for controlling the first decay portion and AND gate circuits 84*a*–84*e* for controlling the second decay portion. The ouptput conditions of the AND gate circuits 82, 83 and 84 are shown in the following Table 9.

TABLE 9

| AND Gate | Output Condition |
|---|---|
| 82a | (FL + TRB + SAX + OB + FUN + TRM) . KON |
| 82b | (HC + JG + ELG) . AT |
| 82c | TRP . KON |
| 83a | (HC + JG + ELG) . DT |
| 83b | HC . DT |
| 84a | (TRB + SAX + TRM) . KOF |
| 84b | (FL + TRP + OB + VI) . KOF |
| 84c | HC . KOF |
| 84d | JG . KOF |
| 84e | ELG . KOF |

The control waveform generator 13 shown in FIG. 9 further comprises a capacitor 85, discharge resistors 86 and 87 connected across the capacitor 85 and transistors 88*a*–88*e* respectively turned on by the output signals "1" of the AND gate circuits 82*a*–82*e* for applying a voltage −5 V across the capacitor 85 respectively through resistors 89*a*–89*e* having different values. The resistance values of the resistors 89*a*–89*e* are set to 18.8 KΩ, 1.5 KΩ, 3.5 KΩ, 45 KΩ, and 72 KΩ respectively. There are also provided a transistor 90 which is turned ON by the output signal "1" of the AND gate circuit 83*a* for discharging the charge of the capacitor 85 via resistors 91 and 87, a transistor 92 turned on by the output signal "1" of the AND gate circuit 83*b* for short circuiting the two terminals of resistor 91, transistors 93*a*–93*e* turned on by the output signal "1" of the AND gate circuits 84*a*–84*e* for discharging the charge of the capacitor 85 respectively through resistors 94*a*–94*e* having different values, a transistor 95 turned on by the tone generation inhibit signal CC produced by the inhibit signal generator 9 shown in FIG. 5 for rapidly discharging the charge of the capacitor 85 through a resistor 96 having a small value, and a buffer amplifier 97 which produces the terminal voltage of the capacitor 85 as the envelope control waveform CW2.

Figure 10:
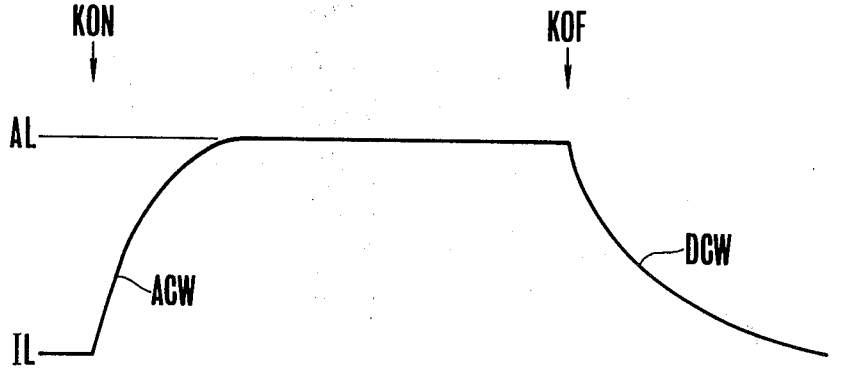
FIGS. 10 and 11 show waveforms useful to explain the operation of the control waveform generator CWG shown in FIG. 1

At the initial state of the CWG 13, since the charge of the capacitor 85 is discharged through resistors 86 and 87 having relatively large values, the initial level IL produced by the buffer amplifier 97 would be zero as shown in FIG. 10. Suppose now that the tone color selection circuit 7 (FIG. 7) has selected the tone color of a tronbone, for example, at this time, only the tone color signal TRB of the tone color selection signals TSS would be "1".

Under these states when the key switch 1 shown in FIG. 1 produces a key-on signal KON("1") as a result of depression of a key, the output signal of the AND gate circuit 82*a* of the charging and discharging control circuit 81 is "1" as shown in Table 9. Then, the transistor 88*a* is turned on to charge capacitor 85 via resistor 89*a* to −5 V. Since the resistor 89*a* has a relatively high resistance value as above pointed out, the terminal voltage of the capacitor varies gradually toward −5 V, i.e. the attack level AL shown in FIG. 10, thereby forming the attack waveform ACW shown in FIG. 10.

When a depressed key of the key switch 1 is released, the CWG sequence control circuit 11 (FIG. 6) produces a key-off signal ("1"). Then the output signal of the AND gate circuit 84*a* of the charging and discharging control circuit 81 becomes "1" as shown in Table 9. As a consequence, the transistor 93*a* is turned on to discharge the charge of the capacitor 85 which has been charged up to the attack level AL of −5 V via resistor 94*a*. Accordingly, the terminal voltage of the capacitor 85 varies towards the initial level IL(0 V) according to the discharge characteristic determined by the value of resistor 94*a* as shown in FIG. 10, thus forming a decay waveform DCW shown in FIG. 10 with the result that the buffer amplifier 97 supplied with the terminal voltage of the capacitor 85 produces a persistent control waveform CW2 suitable for the tone color of a trombone, as shown in FIG. 10.

When the tone color selection circuit 7 (FIG. 2) selects a percussive tone color of a jazz guitar (i.e. switch 20*h* is closed) only the tone color signal JG of the tone color control signal TSS becomes "1".

Under these conditions, if a key-on signal KON("1") is produced due to depression of a key, and if in response to this key-on signal the CWG sequence controller 11 (FIG. 6) produces an attack signal AT("1") having a width designated by the tone color signal JG, as shown in Table 9, the AND gate circuit 82*b* of the charging and discharging circuit 81 would produce an output signal "1". Then the transistor 88*b* is turned on whereby the capacitor 85 is charged to −5 V through resistor 89*b*. Since resistor 89*b* has a relatively small resistance value, the terminal voltage of capacitor 85 rapidly changes from the initial level IL(0 V) to the attack level of −5 V, thus forming an attack waveform.

Thereafter, when the attack signal AT generated by the CWG sequence controller 11 becomes "0" and while at the same time when a new decay signal DT("1") is produced, as shown in Table 9, the output of the AND gate circuit 83*a* of the charging and discharging control circuit 81 becomes "1". Then, the transistor 90 is turned on to discharge the capacitor 85 through resistors 91 and 87. As a consequence, as shown by 1DCW shown in FIG. 11, a first decay waveform is obtained in which the terminal voltage of the capacitor 85 gradually varies toward the initial level IL(0 V).

When the CWG sequence control circuit 11 produces a key-off signal KOF("1") as a result of release of a depressed key as shown in Table 9, the output of the AND gate circuit 84*d* of the charging and discharging control circuit 81 becomes "1". Consequently, the transistor 93*d* is turned on to discharge the capacitor 85 through resistor 94*d* having a small value whereby the terminal voltage of the capacitor 85 rapidly varies toward the initial level IL(0 V) as shown by 2DCW in FIG. 11, thus forming a second decay waveform. As a consequence, the buffer amplifier 97 supplied with the terminal voltage of the capacitor 85 produces a percussive control waveform CW2 as shown in FIG. 11 which is suitable for the tone color of a jazz guitar.

When the tone color selection of the tone color selection circuit 7 (FIG. 2) is changed so that the inhibit signal generator 9 (FIG. 5) produces the tone generation inhibit signal CC ("1"), the transistor 95 would be rendered on, with the result that the capacitor 85 would be rapidly discharged through resistor 96 having a very small value. Accordingly, under any state, during an interval in which the tone generation inhibit signal CC("1") is being generated, the capacitor 85 would be discharged to rapidly decrease its terminal voltage to the initial level IL(0 V). As a consequence, also the control waveform CW2 produced by the buffer amplifier 97 becomes the initial level IL during an interval in which the tone generation inhibit signal CC is being produced. As a consequence, the VCA 5 (FIG. 1) supplied with the control waveform CW2 as an amplitude control input greatly reduces its output level during the tone generation inhibit signal CC thus preventing generation of noise (click) and unwanted musical tone at the time of changing the tone color selection.

G. Control voltage generator 16

Figure 12:
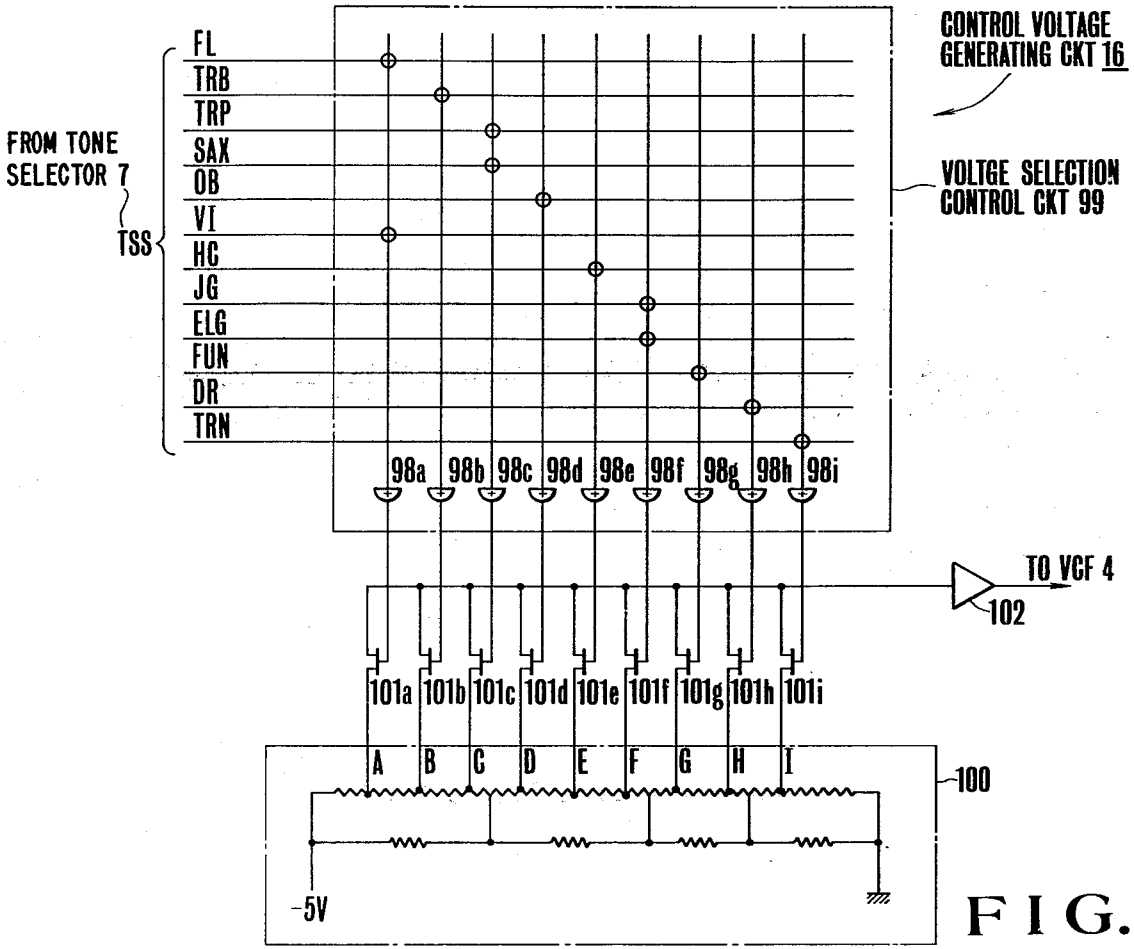
FIG. 12 is a connection diagram showing the detail of one example of the control voltage generator shown in FIG. 1.

The detail of the control voltage generator 16 shown in FIG. 1 is shown in FIG. 12. As shown, the control voltage generator 16 comprises a voltage selection control circuit 99 including OR gate circuits 98*a*–98*i* which produce 9 types of the voltage selection signals corresponding to the tone color selection signals TSS (tone color signals FL-TRM) produced by the tone color selection circuit 7, transistors 101*a*–101*i* respectively selecting the voltages at junctions A-I of a potentiometer 100 in accordance with the output signals of the OR gate circuits 98*a*–98*i*, and a buffer amplifier 102 which supplies the voltage signals selected by transistors 101*a*–101*i* to the VCF 4 shown in FIG. 1 to act as the control voltage signals.

In the control voltage generator 16 described above, when the tone color selection circuit 7 (FIG. 2) selects the tone color of a flute (i.e. switch 20*a* is closed), only the tone color signal FL of the tone color selection signals TSS becomes "1". Then, the output of only the OR gate circuit 98*a* of the voltage selection control circuit 99 becomes "1" thereby turning on transistor 101*a*. Then, transistor 101*a* selects the voltage at the junction A of the potentiometer 100 to supply it to VCF 4 shown in FIG. 1 via buffer amplifier 102 to act as the control voltage signal thus setting the characteristic of the VCF 4 to be suitable for producing a tone color of a flute.

As above described, the CWG 12, CWG 13 and the CWG sequence controller 11 which control the VCF 4 and VCA 5 constitute the envelope generator, the substance of this invention in which by suitably varying the time constant and target values of charging and discharging of the capacitors 75 and 85 in accordance with a musical tone of a generated musical tone, it is possible to readily vary the shape of the control waveform generated.

In the CWG 12 and CWG 13 where it is impossible to increase beyond a certain limit the rate of discharge and charge due to resistance of the gating transistors themselves when they are conductive, it becomes possible to increase the charging and discharging rate by increasing the voltage of a voltage source.

Although in the preferred embodiment, two discharging circuits and one charging circuit are provided for a capacitor it will be clear that one discharging circuit and two charging circuits may be used. In the latter case, the charging and discharging circuits shown in the embodiment are exchanged. In other words, the charging circuit is used as the discharging circuit and the discharging circuits are used as the charging circuit.

Furthermore, in the illustrated embodiment, the time constant of charging and discharging the capacitor is varied by varying the count of a counter, the same object can also be accomplished by constructing the timing pulse generator 19 such that the period of the pulse signal TP generated by the timing pulse generator 19 is varied with the output of a counter.

As above described, the control waveform generator of an electronic musical instrument embodying the invention is constituted by a counter which starts to count the number of pulse signals in response to generation of a key-on signal indicative of a key depression, a detection circuit which produces a first detection signal during an interval in which the count of the counter reaches a predetermined value and then produces a second detection signal during an interval in which the key-on signal disappears, a capacitor whose terminal voltage can be derived out as an control waveform, a charging circuit operated by the first detection circuit for charging (discharging) the capacitor, a first capacitor discharging (charging) circuit operated by the second detection signal, and a second capacitor discharging (charging) circuit which operates when the key-on signal disappears so that it is possible not only to fabricate substantially all circuit components except the capacitor with semiconductor integrated circuits, but also to simplify the circuit construction and readily change the control waveform to the generated.

What is claimed is:

1. A control waveform generator for an electronic musical instrument for generating a control waveform adapted to control at least one tonal element in response to the depression and release of a key among a plurality of keys, said control waveform generator comprising:

a pulse generator for generating a pulse signal having a repetitive frequency;

a detector including a counter which starts to count the number of said pulse signals when a key is depressed, said detector generating a first detection signal and a second detection signal, said first detection signal generated during an interval between a time when said key is depressed and a time at which a count of said counter reaches a target value, said second detection signal generated during an interval between a time when the counter counts the target value and a time when said depressed key is released;

a capacitor, a terminal voltage of said capacitor being taken out as said control waveform;

a first circuit responsive to said first detection signal for carrying out one of a charge operation and a discharge operation for said capacitor;

a second circuit responsive to said second detection signal for carrying out the other one of said charge and discharge operations for said capacitor; and a third circuit for carrying out the other one of said charge and discharge operations for said capacitor when said depressed key is released.

2. A control waveform generator according to claim 1 wherein said detector includes means for setting said target value to which said counter counts according to a tone color of a musical tone to be generated.

3. A control waveform generator according to claim 1 or 2 wherein each of said first, second and third circuits includes means for setting a time constant thereof according to a tone color of a musical tone to be generated.

4. A control waveform generator according to claim 1 or 2 wherein each of said first, second and third circuits includes means for setting charging and discharging target values for charging and discharging said capacitor according to a tone color of a musical tone to be generated.

5. A control waveform generator according to claim 4 wherein said first, second and third circuits include a source of direct current, a plurality of resistors having tapping points, said resistors connected across said source of direct current, means for combining said tapping points of said resistors to form a resistance ladder, and means for deriving out said capacitor charging and discharging target values from selected tapping points.

6. A control waveform generator according to claim 1 wherein said pulse signal generated by said pulse generator has a variable repetitive frequency.

7. A control waveform generator for an electronic musical instrument for generating a control waveform adapted to control at least one tonal element of a musical tone in response to the depression and release of a key among a plurality of keys, said musical tone including a tone pitch, a tone color and a tone volume, said control waveform generator comprising:

a pulse generator for generating a pulse signal having a repetitive frequency;

a detector including a counter which starts to count the number of said pulse signals in response to a key depression, said detector generating a first detection signal during an interval between a time corresponding to said key depression and a time at which a count of said counter reaches a target value and generating a second detection signal from a time when the counter counts the target value until a time corresponding to release of said depressed key;

a capacitor, a terminal voltage of said capacitor being taken out as said control waveform;

a first circuit responsive to said first detection signal for carrying out one of a charge operation and a discharge operation for said capacitor;

a second circuit responsive to said second detection signal for carrying out the other of said charge and discharge operations for said capacitor; and a third circuit for carrying out said other one of said charge and discharge operations for said capacitor when said depressed key is released, thereby generating the control waveform represented by the terminal voltage of said capacitor, said tonal element being controlled in accordance with the control waveform.

* * * * *